US009608330B2

(12) United States Patent
Singleton et al.

(10) Patent No.: US 9,608,330 B2
(45) Date of Patent: Mar. 28, 2017

(54) SUPERLUMINAL ANTENNA

(75) Inventors: John Singleton, Los Alamos, NM (US); Lawrence M. Earley, Los Alamos, NM (US); Frank L. Krawczyk, Santa Fe, NM (US); James M. Potter, Los Alamos, NM (US); William P. Romero, Los Alamos, NM (US); Zhi-Fu Wang, Los Alamos, NM (US)

(73) Assignee: Los Alamos National Laboratory, Los Alamos, NM (US)

( * ) Notice: Subject to any disclaimer, the term of this patent is extended or adjusted under 35 U.S.C. 154(b) by 737 days.

(21) Appl. No.: 13/368,200

(22) Filed: Feb. 7, 2012

(65) Prior Publication Data

US 2013/0201073 A1 Aug. 8, 2013

(51) Int. Cl.

| | |
|---|---|
| ***H01Q 1/50*** | (2006.01) |
| ***H01Q 9/04*** | (2006.01) |
| ***H01Q 21/20*** | (2006.01) |
| ***H01P 5/08*** | (2006.01) |

(52) U.S. Cl.

CPC ..... *H01Q 9/0485* (2013.01); *H01P 5/085* (2013.01); *H01Q 21/205* (2013.01)

(58) Field of Classification Search

CPC ..... H01Q 9/0485
USPC ..... 343/795, 872, 789, 821, 859, 700 MS
See application file for complete search history.

(56) References Cited

U.S. PATENT DOCUMENTS

| | | | | |
|---|---|---|---|---|
| 3,239,838 A * | 3/1966 | Kelleher | 343/789 | |
| 4,405,925 A * | 9/1983 | Lindner | G01S 7/03 342/175 | |
| 4,495,505 A * | 1/1985 | Shields | H01Q 9/065 333/26 | |
| 4,686,536 A * | 8/1987 | Allcock | H01Q 9/065 343/700 MS | |
| 5,389,937 A | 2/1995 | Kaloi | | |
| 6,362,793 B1 | 3/2002 | Sawamura et al. | | |
| 6,657,601 B2 * | 12/2003 | McLean | H01Q 9/20 343/791 | |
| 7,030,827 B2 * | 4/2006 | Mahler et al. | 343/772 | |
| 7,236,139 B2 * | 6/2007 | Waschenko | 343/790 | |
| 7,764,236 B2 * | 7/2010 | Hill | H01Q 1/243 343/702 | |

(Continued)

OTHER PUBLICATIONS

Antenna Theory, Bazooka Baluns, Apr. 14, 2010 (retrieved on Mar. 27, 2013), retrieved from the Internet: URL:http://www.antenna-theory.com/definitions.bazooka.php, pp. 1-3.

(Continued)

*Primary Examiner* — Dameon E Levi
*Assistant Examiner* — Hasan Islam
(74) *Attorney, Agent, or Firm* — Hahn Loeser & Parks LLP

(57) ABSTRACT

A superluminal antenna element integrates a balun element to better impedance match an input cable or waveguide to a dielectric radiator element, thus preventing stray reflections and consequent undesirable radiation. For example, a dielectric housing material can be used that has a cutout area. A cable can extend into the cutout area. A triangular conductor can function as an impedance transition. An additional cylindrical element functions as a sleeve balun to better impedance match the radiator element to the cable.

11 Claims, 6 Drawing Sheets

(56) References Cited

U.S. PATENT DOCUMENTS

| | | | | |
|---|---|---|---|---|
| 8,350,774 | B2 * | 1/2013 | Pickles | H01Q 9/16 343/795 |
| 2003/0174100 | A1 * | 9/2003 | Ogawa | H01Q 1/242 343/895 |
| 2005/0024289 | A1 * | 2/2005 | Fredberg et al. | 343/872 |
| 2006/0192504 | A1 | 8/2006 | Ardavan et al. | |
| 2006/0273976 | A1 * | 12/2006 | Wang et al. | 343/795 |
| 2009/0096698 | A1 * | 4/2009 | Semonov | H01Q 1/24 343/795 |
| 2010/0039324 | A1 | 2/2010 | Singleton et al. | |
| 2010/0328188 | A1 | 12/2010 | Chang et al. | |

OTHER PUBLICATIONS

International Search Report and Written Opinion for PCT/US2013/024769, mailed Apr. 15, 2013, 8 pages.

Singleton et al., "Eighteen-Month Report on LDRD 20080085 DR: Construction and Use of Superluminal Emission Technology Demonstrators with Applications in Radar, Astrophysics, and Secure Communications," Oct. 26, 2011 (Oct. 26, 2011) (retrieved on Mar. 27, 2013). Retrieved from the Internet: URL:http://web.archive.org/web/20111026171554/http://laacg.lanl.gov/superluminal/pubs/DRsummary.pdf, pp. 1-73.

Singleton et al., "Eighteen-Month Report on LDRD 20080085 DR: Construction and Use of Superluminal Emission Technology Demonstrators with Applications in Radar, Astrophysics, and Secure Communications," White paper, LA-UR-09-06784, Oct. 26, 2009, 77 pages.

* cited by examiner

SUPERLUMINAL ANTENNA

ACKNOWLEDGMENT OF GOVERNMENT SUPPORT

This invention was made with government support under Contract No. DE-AC52-06NA25396 awarded by the U.S. Department of Energy. The government has certain rights in the invention.

FIELD

The present application relates to antennas, and, more particularly, to a superluminal antenna for generating a polarization current that exceeds the speed of light.

BACKGROUND

Charged particles cannot travel faster than the speed of light, as is known by Einstein's Special Relativity theory. However, a pattern of electric polarization can travel faster than the speed of light by a coordinated motion of the charged particles. Experiments performed at Oxford University and at Los Alamos National Laboratory established that polarization currents can travel faster than the speed of light. Two rows of closely-spaced electrodes were attached on opposite sides of a strip of dielectric alumina. At time t, a voltage was applied across the first pair of opposing electrodes to generate a polarization current in the dielectric alumina. A short time later, t+delta t, a voltage was applied to the second, adjacent pair of opposing electrodes, whilst the voltage applied to the first electrode pair was switched off, thus moving a polarization current along the dielectric. This process continued for multiple pairs of electrodes arranged along the dielectric. Given the sizes of the devices, superluminal speeds can be readily achieved using switching speeds in the MHz range. More subtle manipulation of the polarization current is possible by controlling magnitudes and timings of voltages applied to the electrodes, or by using carefully-phased oscillatory voltages. The superluminal polarization current emits electromagnetic radiation, so that such devices can be regarded as antennas. Each set of electrodes and the dielectric between them is an antenna element. Since the polarization current radiates, the dielectric between the electrodes is a radiator element of the antenna.

Superluminal emission technology can be applied in a number of areas including radar, directed energy, communications applications, and ground-based astrophysics experiments.

It is desirable to build such a system using a modular approach with identical antenna elements closely spaced along a line or along a curve designed to give a desired, quasi-continuous trajectory in the dielectric for the polarization current. Previously designed modular antenna elements had a coaxial cable connected to each antenna element. For each antenna element, the inner conductor of the coaxial cable was connected to the electrode on one side of the dielectric radiator element and the outer conductor (ground) to an electrode on the other side of the dielectric. The application of a voltage signal to such a connection establishes an electric field across the dielectric radiator element and hence creates the polarization. The connection to ground is straightforward due to the accessibility of the outer conductor. However, the inner conductor requires careful shaping to establish a smooth change in impedance. Moreover, a relative height of the outer conductor to the inner conductor proved difficult to replicate for each antenna element. Given the manufacturing tolerances, small variations in the relative heights of the conductors resulted in wide performance variations. In addition, a concentric conducting tube was provided around the coaxial cable to act as a quarter-wave stub. However, in the original embodiment it was found that the performance of the quarter-wave stub was very susceptible to slight variations in manufacturing tolerance, leading to large variations in performance from almost identical elements. This is clearly undesirable for antenna applications.

SUMMARY

A superluminal antenna element is disclosed that is operationally stable and easy to manufacture.

In one embodiment, the superluminal antenna element integrates a sleeve (or bazooka) balun and a triangular impedance transition to better match the impedance of the coaxial cable to the rest of the antenna element, preventing undesirable stray signals due to reflection. For example, a dielectric housing material can be used that has a cutout area. A cable can extend into the cutout area. A coaxial, cylindrical conductor connected to the screen of the cable and terminated below the conductive shielding element functions as a sleeve balun analogous to those used in conventional dipole antennas. A triangular impedance transition connects the central conductor of the coaxial cable to one side of the radiator element. The other side of the radiator element is connected by a planar conductor and/or conducting block to the screen of the coaxial cable.

By including a sleeve balun and by using the triangular impedance transition, improved impedance matching can be established between a cable (e.g., 50 Ohms impedance) and free space (e.g., 370 Ohms in the air, gas or vacuum above the radiator element). Not only does the impedance matching provide better performance (e.g. reduced leakage), but the current embodiment of the sleeve balun and impedance transition also allows the antenna element to be very consistent in its operation and replication, irrespective of slight variations in the manufacturing process.

The foregoing and other objects, features, and advantages of the invention will become more apparent from the following detailed description, which proceeds with reference to the accompanying figures.

DETAILED DESCRIPTION

Figure 1:
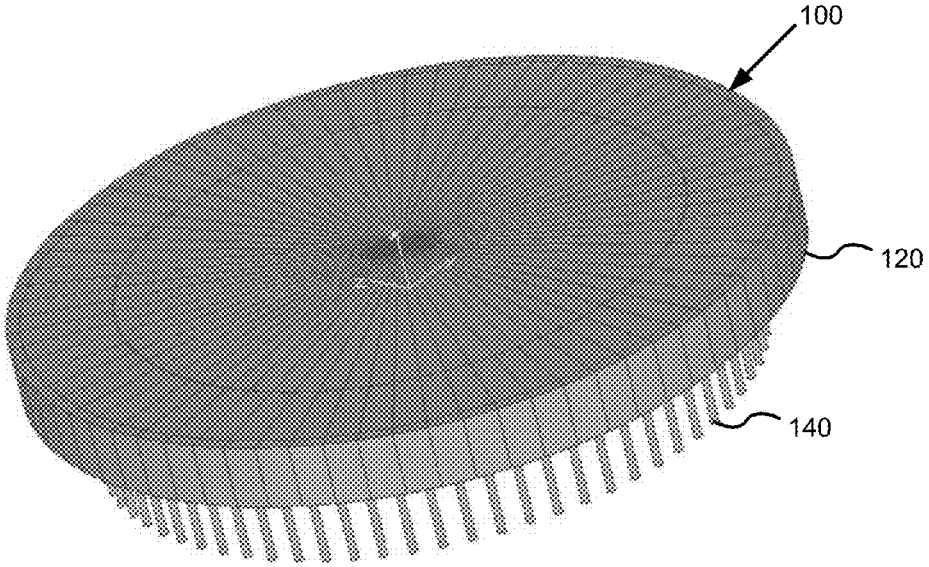
FIG. 1 is an exemplary superluminal antenna including multiple wedge-shaped superluminal antenna elements coupled together.

FIG. 1 shows a superluminal antenna 100 having a plurality of antenna elements, such as shown at 120. Each antenna element has its own cable 140 coupled thereto for delivering the desired voltage signal to the antenna element. Each antenna element comprises a pair of electrodes, placed on either side of a dielectric material. Individual amplifiers (not shown) are coupled to the antenna elements 120 via the cables and can be used to control the polarization currents by applying voltages to the electrodes at desired time intervals or phases. The application of voltage across a pair of electrodes creates a polarized region in between, which can be moved by switching voltages between the electrodes on and off, or by applying oscillatory voltages with appropriate phases. Superluminal speeds can readily be achieved using switching speeds or oscillatory voltages in the MHz-GHz frequency range. The dielectric between each pair of electrodes contains the polarization current that emits the desired radio waves, and thus functions as the radiator element of each antenna element.

The individual antenna elements allow for a modular approach, which is easier to manufacture than previous designs. Although the superluminal antenna 100 is shown as circular, other geometric shapes or configurations can be used. For example, a straight line, curved line or sinusoidal form can be used. Though desirable in many applications, a modular approach is not necessary, and larger blocks of antenna elements can be made using the same principles as described here. For example, radiator elements between antenna elements can be formed from a single monolithic unit or divided into groups of larger antennas.

Figure 2:
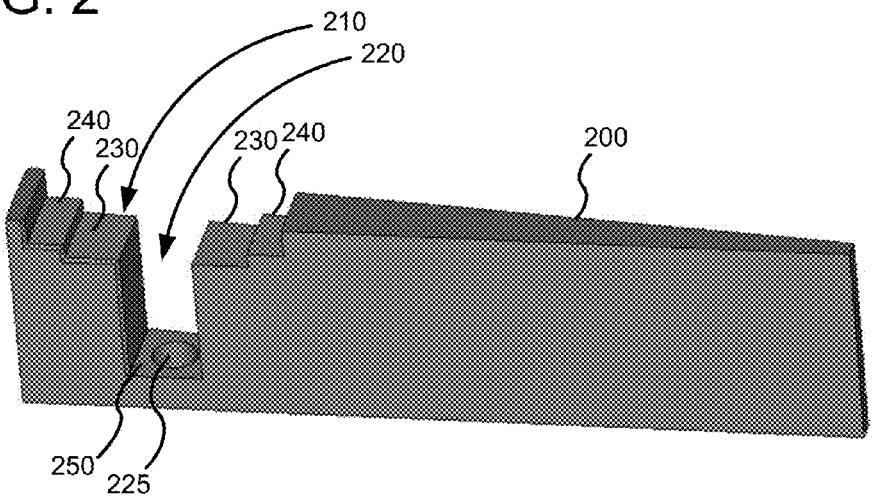
FIG. 2 is a dielectric housing material used to form an exemplary antenna element.

FIG. 2 shows a base portion 200 of an antenna element. The base portion 200 is generally a dielectric housing material having a cutout area 210 and an aperture 225 for receiving a cable. The dielectric housing material can be formed from a wide variety of dielectrics, such as glass epoxy laminates (e.g., G10). Example permittivity values are between 4 and 5, but other permittivity values can be used. The base portion is shown as wedge shaped, but other shapes can be used. The cutout area 210 has a main section 220 into which the cable passes, and a series of opposing steps 230, 240, the outer pair of which, 240, are for mounting a radiator element made from any low loss-tangent dielectric with a reasonably high dielectric constant, such as alumina, as further described below. The cutout area can be a wide variety of shapes, depending on the particular application.

Figure 3:
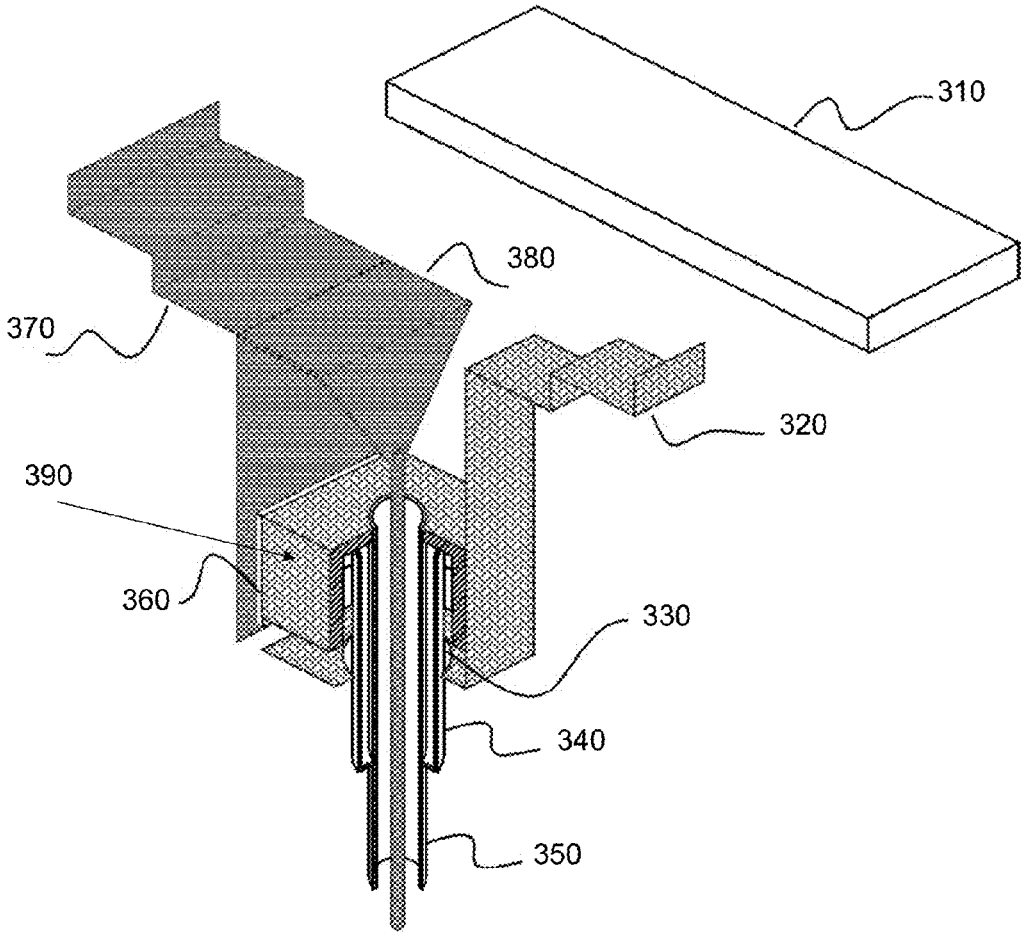
FIG. 3 shows the plated sidewalls within a cutout area of the dielectric housing material, the sleeve balun, triangular impedance transition and planar conductorcoupling a coaxial cable to ground and signal sidewalls.

FIG. 3 shows the metal components of the antenna element that mount within the base portion 200. The inner walls of the base portion 200 adjacent the cutout area are lined with a conductive material 320, 370 (e.g., copper) for carrying transmission signal and ground to opposing ends of a dielectric radiator element in the fully assembled antenna element. The conductive material forms a ground conductor 320 and a signal conductor 370 electrically separated by a layer of non-conductive material 360, such as Teflon. When in use, the dielectric radiator element 310 rests between the upper vertical boundaries of conductors 320 and 370. The radiator element 310 can be made from any low loss-tangent dielectric with a reasonably high dielectric constant. The coaxial cable 350 enters the base of the unit, and is surrounded by the coaxial tube functioning as a sleeve balun 340. The lower extremity of the sleeve balun 340 is connected to the screen of the coaxial cable 350; the upper extremity can be not connected. A conductive, triangular impedance transition 380 is coupled between the central conductor of cable 350 and the signal conductor layer 370. At an end wherein the impedance matching element 380 couples to the signal conductor 370, the impedance matching element is approximately the width of the signal conductor and then tapers at an opposite end to couple to the drive conductor in the cable. In applications where negligible leakage of radiation into the area below the antenna element is desired. a conductive block 390 may be attached to the screen of cable 350, but may not make contact with, the upper part of the sleeve balun 340. Additional isolation of the balun 340 can be provided by a circular gap 330.

Figure 4:
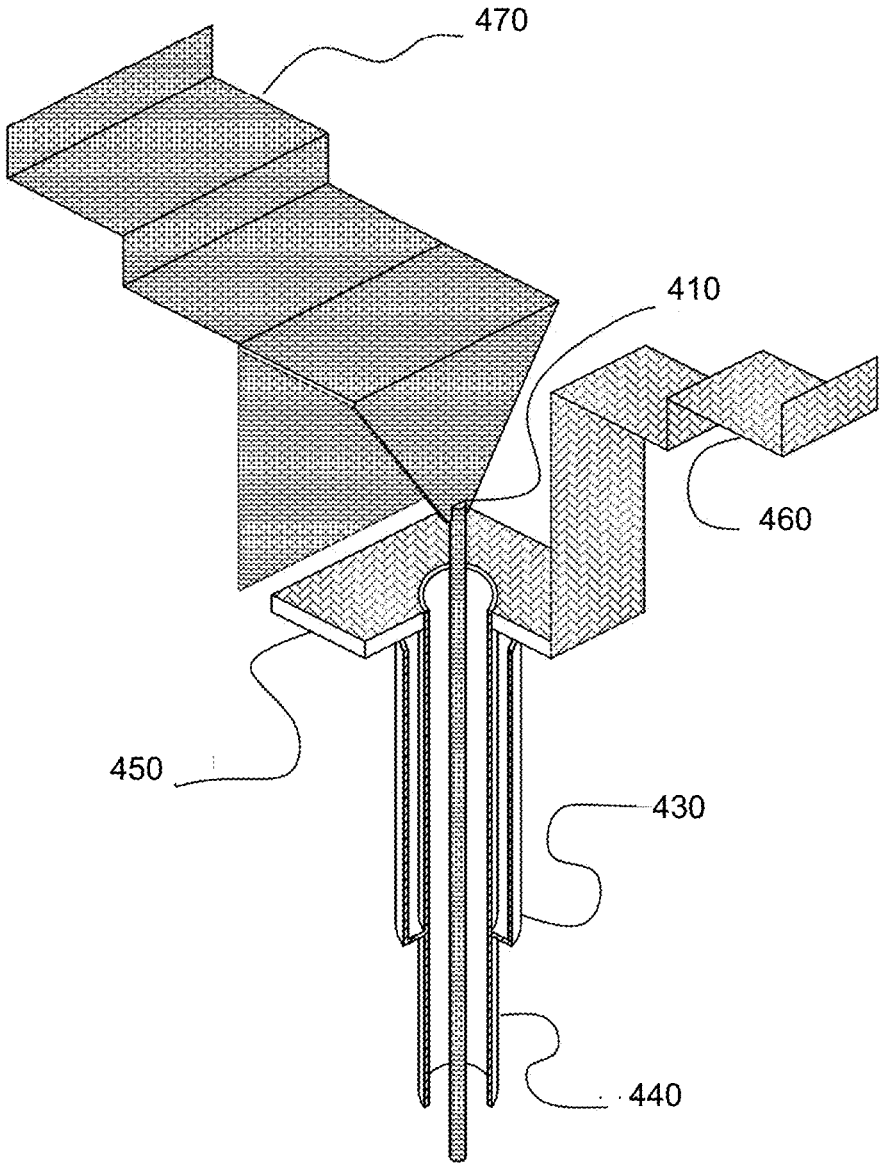
FIG. 4 shows an alternative embodiment of the conductive components within the antenna element with a simplified ground conductor.

FIG. 4 shows an alternative compact embodiment that gives similar antenna performance. Here, the conductive block 390 is replaced by a conductive slab 450 that is connected directly to the ground conductor 460, and covers (but does not touch) the end of the sleeve balun 430. Electrical insulation between the ground conductor 460 and the signal conductor 470 is provided by a gap. The coaxial cable 440, sleeve balun 430 and connection 410 between the cable's central conductor and the conductive impedance transition can be similar to the previously described embodiment.

As shown below, the impedance transition when used in conjunction with the sleeve balun 430, 340 establishes better impedance matching from the coaxial line to the radiator element. This improvement makes the antenna element operationally stable and greatly increases reproducibility against slight variations in manufacturing. The cable can be a coaxial cable having multiple conductors for carrying a signal and ground. Additionally, the cable can include dielectric material positioned between the signal and ground conductors. The cable can be replaced with any desired signal conductor, such as a waveguide, traces on a printed circuit board, etc.

Figure 5:
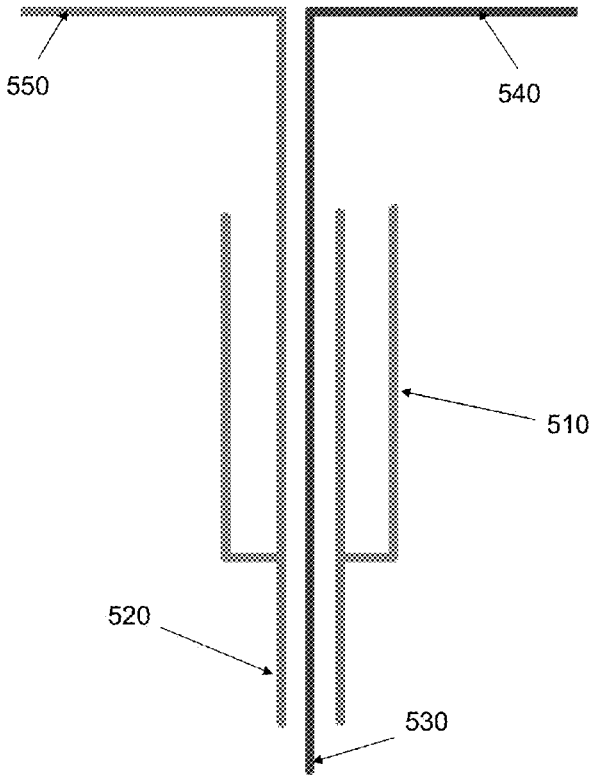
FIG. 5 shows the current paths through the antenna element.

FIG. 5 shows a simplified section of the element to illustrate the electrical connection of the cable and sleeve balun to the signal and ground conductors; this differs from previous designs. The signal conductor 540 couples a drive line 530 from the coaxial cable to one side of the radiator element. A ground conductor 550, encompassing the top of the conductive element (i.e., block or slab), couples the ground from screen 520 of the cable to the opposite side of the radiator element. The sleeve balun 510 is connected to a lower part of the screen of the coaxial cable. Consequently, by creating a sleeve balun, and by including the impedance transition, impedance matching is established between the coaxial cable (50 Ohms impedance) and free space (370 Ohms impedance in the air, gas or vacuum directly above the radiator element). Not only does the impedance matching provide better performance, but the sleeve balun and the impedance transition also allow the antenna element to be consistent in its operation and replication.

Figure 6:
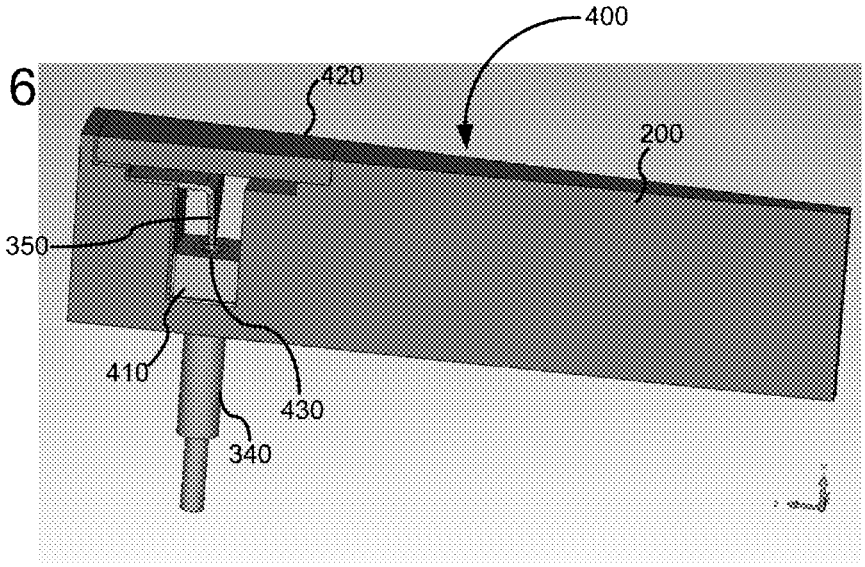
FIG. 6 shows the antenna element fully assembled including a radiator element and a sleeve balun through which the coaxial cable passes.

FIG. 6 shows an assembled antenna element 400. A conductive block 410 is positioned within the cutout area and includes a hole therein through which the sleeve balun 340 containing the coaxial passes. As explained previously, the conductive block is an exemplary conducting element and can be replaced by alternative elements. A dielectric radiator element 420 is mounted within the cutout area so as to couple at one end to the signal conductor 370 and, at an opposite end, to ground conductor 320. The radiator element can be made from any low loss-tangent dielectric with a reasonably high dielectric constant. The impedance transition and the sleeve balun 340 act to make the antenna element operationally stable and increase reproducibility against slight variations in manufacturing. The cable can be a coaxial cable having multiple conductors for carrying a signal and ground. Additionally, the cable can include dielectric material positioned between the signal and ground conductors. With suitable modifications to the balun geometry, the cable can be replaced with any desired signal conductor, such as a waveguide, traces on a printed circuit board, etc.

Figure 7:
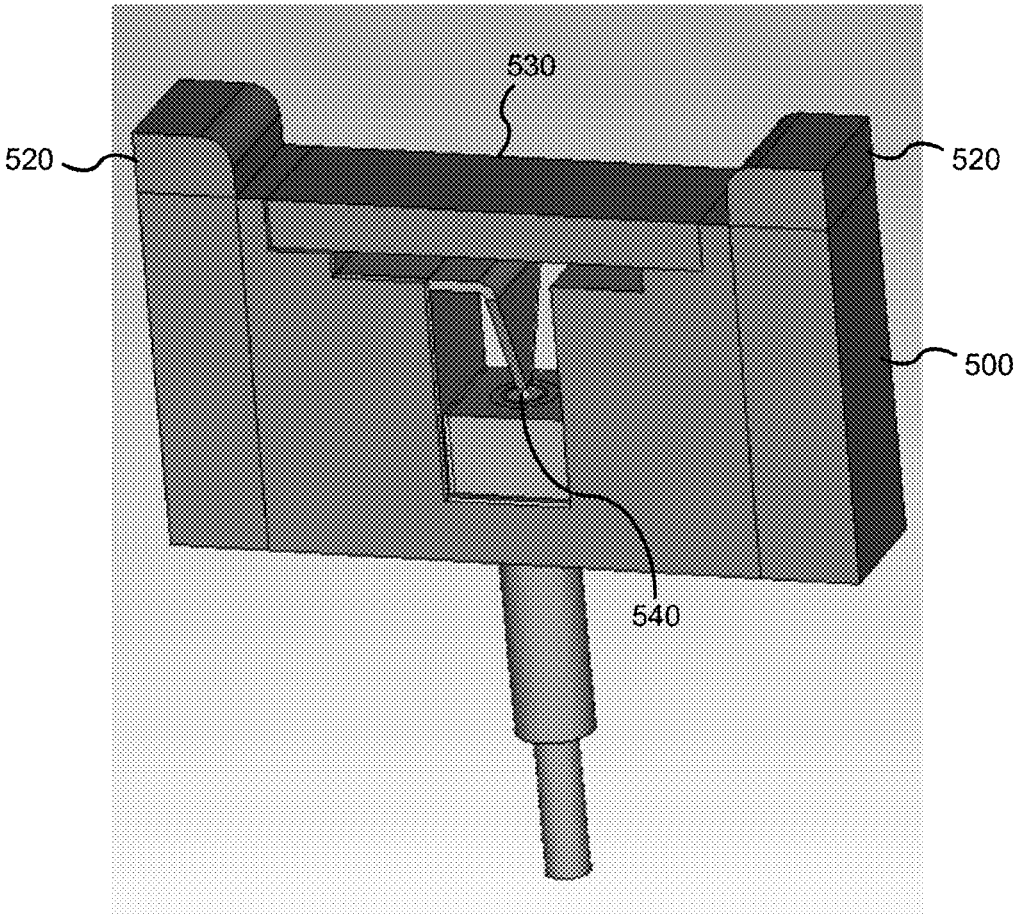
FIG. 7 shows a second embodiment of an antenna element, wherein the antenna element is rectangular shaped.

FIG. 7 shows a second embodiment of an antenna element wherein a base portion 500 is rectangular shaped. The rectangular-shaped base portion 500 can include protruding blocks 520 positioned at opposing ends of a radiator element 530. The blocks 520 may improve the radiation pattern. Not all features of the antenna element will be described, as it is similar to the wedge-shaped embodiment.

Figure 8:
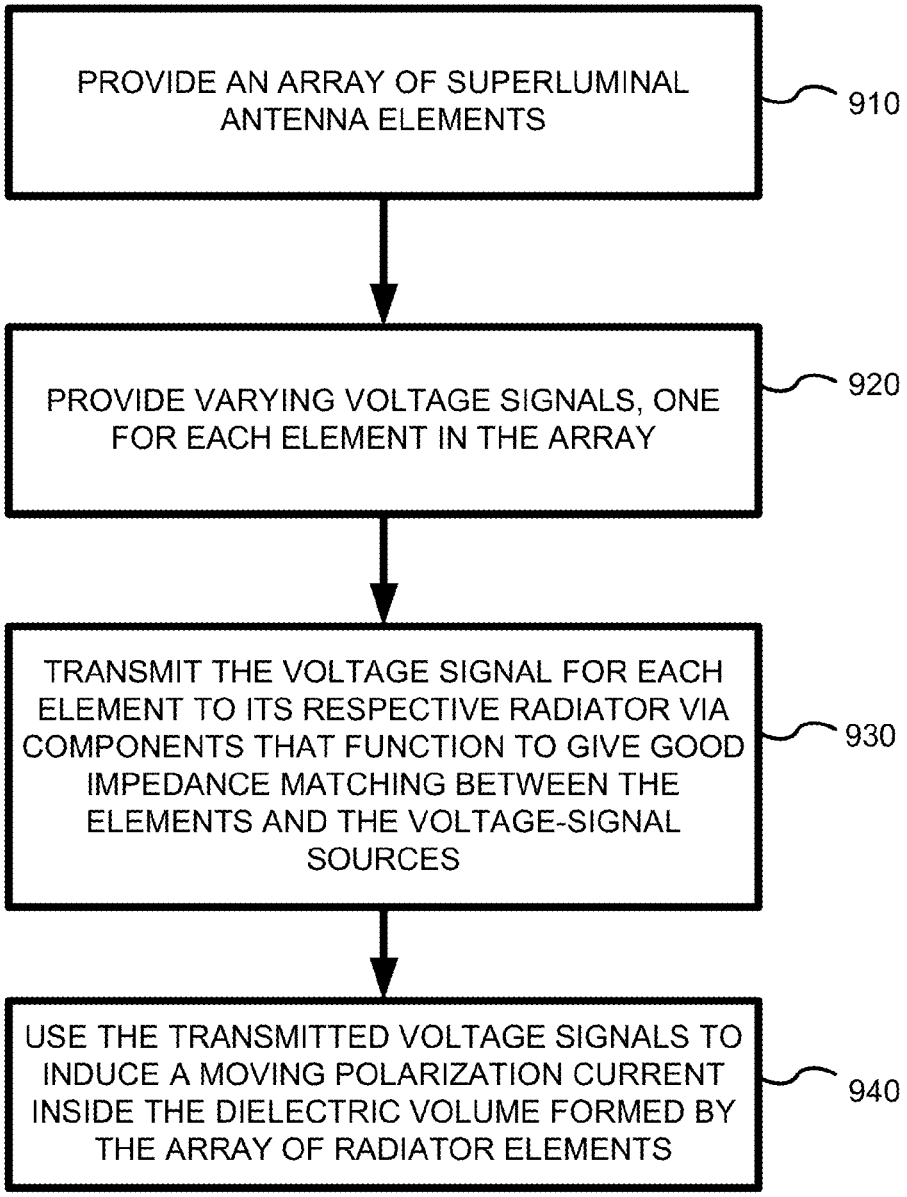
FIG. 8 is flowchart of a method for using a balun-type element in a superluminal antenna.

FIG. 8 is a flowchart of a method for shielding a superluminal antenna element. In process block 910, an array of superluminal antenna elements are provided. In process block 920, varying voltage signals are provided, one for each element in the array. The voltage signals can be provided using a series of coaxial or other input cables, signal conductors, or waveguides. In process block 930, a voltage signal is transmitted from each cable, signal conductor, or waveguide to its corresponding radiator element. The transmission is made via components that function as a sleeve balun and an impedance transition. In process block 940, the transmitted voltage signals are used to induce a moving polarization current inside the dielectric volume formed by the array of radiator elements.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope of these claims.

We claim:

1. A superluminal antenna element, comprising:

a dielectric housing having a cutout, the cutout having a first plurality of steps and a second plurality of steps, the first and second pluralities of steps arranged in opposing pairs;

a first conductive element substantially covering the first plurality of steps;

a second conductive element substantially covering the second plurality of steps;

a dielectric radiator element mounted within the cutout area, the radiator element having first and second spaced ends mounted in an opposing pair of steps;

a conductive impedance transition electrically connected to the first conductive element;

and sleeve balun depending from and electrically connected to the second conductive element; whereby imposing a time-varying signal on the first and second conductive elements induces a polarization current in the dielectric radiator element.

2. The superluminal antenna element of claim 1, further comprising first and second coaxial conductors with a conducting cylinder connected to them in such a way to form a sleeve or bazooka balun.

3. The superluminal antenna element of claim 1, wherein the cutout area is plated with conductive material to form the first and second conductive elements.

4. The superluminal antenna element of claim 1, further including a conductive block positioned within the cutout area and having a hole therein through which a cable passes.

5. The superluminal antenna element of claim 1, further including a conductive impedance matching element coupled between the radiator element and the feed conductor.

6. The superluminal antenna element of claim 5, wherein the conductive impedance matching element gradually changes the impedance from the impedance at the feed conductor to the impedance at the radiator element.

7. The superluminal antenna of claim 1, wherein the dielectric material includes a glass epoxy laminate.

8. The superluminal antenna of claim 1, wherein the radiator element is formed from a low-loss-tangent dielectric.

9. The superluminal antenna of claim 1, further comprising a coaxial cable including first and second conductors coupled to the first conductive element and the second conductive element respectively, wherein the first conductor and the second conductor share a same geometric axis.

10. The superluminal antenna of claim 1, wherein the dielectric housing is rectangular or wedge shaped.

11. The antenna element of claim 1, wherein the radiating element is mounted within an outermost pair of opposing steps.

* * * * *